US006304846B1

(12) United States Patent
George et al.

(10) Patent No.: US 6,304,846 B1
(45) Date of Patent: Oct. 16, 2001

(54) SINGING VOICE SYNTHESIS

(75) Inventors: E. Bryan George, Carrollton, TX (US); Michael W. Macon, Portland, OR (US); Leslie Jensen-Link, Roswell; James Oliverio, Atlanta, both of GA (US); Mark Clements, Lilburn, GA (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 09/161,799

(22) Filed: Sep. 28, 1998

Related U.S. Application Data

(60) Provisional application No. 60/062,712, filed on Oct. 22, 1997.

(51) Int. Cl.[7] ..... G10L 21/00

(52) U.S. Cl. ..... 704/270; 704/205

(58) Field of Search ..... 704/270, 500, 704/205–209; 434/307; 84/622

(56) References Cited

U.S. PATENT DOCUMENTS 4,731,847 * 3/1988 Lybrook et al. ..... 381/51
5,235,124 * 8/1993 Okamura et al. ..... 84/601
5,321,794 * 6/1994 Tamura ..... 704/260
5,471,009 * 11/1995 Oba et al. ..... 84/645
5,703,311 * 12/1997 Ohta ..... 84/622
6,006,175 * 12/1999 Holzrichter ..... 704/208

* cited by examiner

*Primary Examiner*—Fan Tsang
*Assistant Examiner*—Michael N. Opsasnick
(74) *Attorney, Agent, or Firm*—Robert L. Troike; Frederick J. Telecky, Jr.

(57) ABSTRACT

A method of singing voice synthesis uses commercially-available MIDI-based music composition software as a user interface (13). The user specifies a musical score and lyrics; as well as other music control parameters. The control information is stored in a MIDI file (11). Based on the input to the MIDI file (11) the system selects synthesis model parameters from an inventory (15) of linguistic voice data units. The units are selected and concatenated in a linguistic processor (17). The units are smoothed in the processing and are modified according to the music control parameters in musical processor (19) to modify the pitch, duration, and spectral characteristics of the concatenated voice units as specified by the musical score. The output waveform is synthesized using a sinusoidal model 20.

5 Claims, 10 Drawing Sheets

| | OUTPUT UNIT(S) | UNIT CONTEXT(S) | SCORE |
|---|---|---|---|
| 1 | T | $x_L\ P_1\ x_R$ | 1 |
| 2 | LD_RD | $x_L\ P_1\ c_R$<br>$c_L\ P_1\ x_R$ | 2 |
| 3 | LD_RD | $x_L\ P_1$<br>$c_L\ P_1\ x_R$ | 3 |
| 4 | LD_RD | $x_L\ P_1\ c_R$<br>$P_2\ x_R$ | 3 |
| 5 | LD_RD | $x_L\ P_1$<br>$P_2\ x_R$ | 4 |
| 6 | LDr | $x_L\ P_1\ c_R$ | 5 |
| 7 | RDl | $c_L\ P_1\ x_R$ | 5 |
| 8 | LD_RM | $x_L\ P_1$<br>$c_L\ P_2\ c_R$ | 6 |
| 9 | LM_RD | $c_L\ P_1\ c_R$<br>$P_2\ x_R$ | 6 |

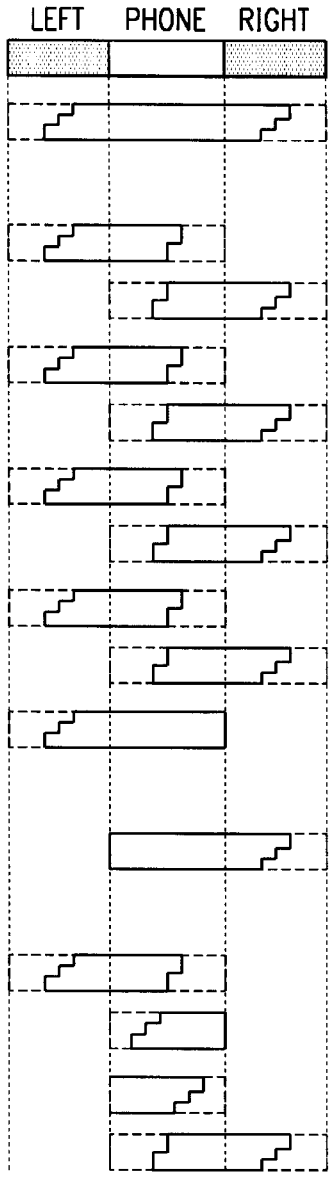

OUTPUTS

M -MONOPHONE
T -TRIPHONE
LDr -LEFT DIPHONE ONLY
RDl -RIGHT DIPHONE ONLY
LD_RD -LEFT DIPHONE/RIGHT DIPHONE
LD_RM -LEFT DIPHONE/MONOPHONE
LM_RM -MONOPHONE/MONOPHONE
LM_RD -MONOPHONE/RIGHT DIPHONE

TESTS

$x_L$ -LEFT EXACT MATCH
$x_R$ -RIGHT EXACT MATCH
$c_L$ -LEFT CLASS MATCH
$c_R$ -RIGHT CLASS MATCH
$P_1$ -PHONEME MATCH 1
$P_2$ -PHONEME MATCH 2

*FIG. 2A*

| | OUTPUT UNIT(S) | UNIT CONTEXT(S) | SCORE |
|---|---|---|---|
| 10 | LD_RM | $x_L$ $P_1$ $P_2$ $c_R$ | 7 |
| 11 | LM_RD | $c_L$ $P_1$ $P_2$ $x_R$ | 7 |
| 12 | LDr | $x_L$ $P_1$ | 8 |
| 13 | RDI | $P_2$ $x_R$ | 8 |
| 14 | M | $c_L$ $P_1$ $c_R$ | 9 |
| 15 | LM_RM | $c_L$ $P_1$ $P_2$ $c_R$ | 10 |
| 16 | M | $c_L$ $P_1$ | 11 |
| 17 | M | $P_2$ $c_R$ | 11 |
| 18 | M | $P_1$ | 12 |

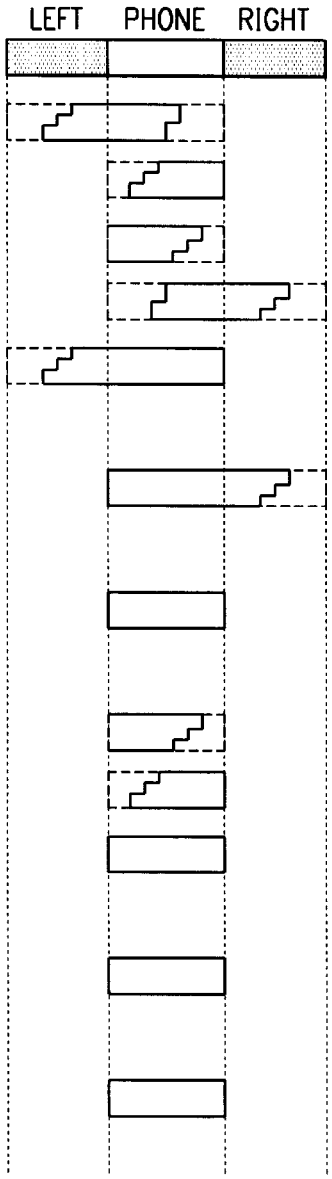

OUTPUTS

M -MONOPHONE
T -TRIPHONE
LDr -LEFT DIPHONE ONLY
RDI -RIGHT DIPHONE ONLY
LD_RD -LEFT DIPHONE/RIGHT DIPHONE
LD_RM -LEFT DIPHONE/MONOPHONE
LM_RM -MONOPHONE/MONOPHONE
LM_RD -MONOPHONE/RIGHT DIPHONE

TESTS $x_L$ -LEFT EXACT MATCH
$x_R$ -RIGHT EXACT MATCH
$c_L$ -LEFT CLASS MATCH
$c_R$ -RIGHT CLASS MATCH
$P_1$ -PHONEME MATCH 1
$P_2$ -PHONEME MATCH 2

*FIG. 2B*

| FROM | T | LD | LDr | RD | RDI | LM | RM | M | NULL |
|---|---|---|---|---|---|---|---|---|---|
| T | M | M | M | M | M | X | M | X | A |
| LD | M | M | M | M | M | X | M | X | A |
| LDr | M | M | M | M | A | A | X | A | A |
| RD | M | M | M | M | M | M | M | M | A |
| RDI | M | M | M | M | M | M | M | M | A |
| LM | M | M | M | M | X | X | M | X | X |
| RM | M | M | M | X | A | A | X | A | A |
| M | M | M | M | X | A | A | X | A | A |
| NULL | A | A | A | A | A | A | X | A | A |

M -MERGE
A -ABUT
X -ILLEGAL

SINGING VOICE SYNTHESIS

This application claims priority under 35 USC § 119(e) (1) of provisional application No. 60/062,712, filed Oct. 22, 1997.

TECHNICAL FIELD OF THE INVENTION

This invention relates to singing voice synthesis and more particularly to synthesis by concatenation of waveform segments.

BACKGROUND OF THE INVENTION

Speech and singing differ significantly in terms of their production and perception by humans. In singing, for example, the intelligibility of the phonemic message is often secondary to the intonation and musical qualities of the voice. Vowels are often sustained much longer in singing than in speech, and precise, independent control of pitch and loudness over a large range is required. These requirements significantly differentiate synthesis of singing from speech synthesis.

Most previous approaches to synthesis of singing have relied on models that attempt to accurately characterize the human speech production mechanism. For example, the SPASM system developed by Cook (P. R. Cook, "SPASM, A Real Time Vocal Tract Physical Model Controller And Singer, The Companion Software Synthesis System," Computer Music Journal, Vol. 17, pp. 30–43, Spring 1993.) employs an articulator-based tube representation of the vocal tract and a time-domain glottal pulse input. Formant synthesizers such as the CHANT system (Bennett, et al., "Synthesis of the Singing Voice," in Current Directions in Computer Music Research, pp. 19–49, MIT Press 1989.) rely on direct representation and control of the resonances produced by the shape of the vocal tract. Each of these techniques relies, to a degree, on accurate modeling of the dynamic characteristics of the speech production process by an approximation to the articulartory system. Sinusoidal signal models are somewhat more general representations that are capable of high-quality modeling, modification, and synthesis of both speech and music signals. The success of previous work in speech and music synthesis motivates the application of sinusoidal modeling to the synthesis of singing voice.

In the article entitled, "Frequency Modulation Synthesis of the Singing Voice," in Current Directions in Computer Research, (pp. 57–64, MIT Press, 1989) John Chowning has experimented with frequency modulation (FM) synthesis of the singing voice. This technique, which has been a popular method of music synthesis for over 20 years, relies on creating complex spectra with a small number of simple FM oscillators. Although this method offers a low-complexity method of producing rich spectra and musically interesting sounds, it has little or no correspondence to the acoustics of the voice, and seems difficult to control. The methods Chowning has devised resemble the "formant waveform" synthesis method of CHANT, where each formant waveform is created by an FM oscillator.

Mather and Beauchamp in an article entitled, "An Investigation of Vocal Vibrato for Synthesis," in Applied Acoustics, (Vol. 30, pp. 219–245, 1990) have experimented with wavetable synthesis of singing voice. Wavetable synthesis is a low complexity method that involves filling a buffer with one period of a periodic waveform, and then cycling through this buffer to choose output samples. Pitch modification is made possible by cycling through the buffer at various rates. The waveform evolution is handled by updating samples of the buffer with new values as time evolves. Experiments were conducted to determine the perceptual necessity of the amplitude modulation which arises from frequency modulating a source that excites a fixed-formant filter—a more difficult effect to achieve in wavetable synthesis than in source/filter schemes. They found that this timbral/amplitude modulation was a critical component of naturalness, and should be included in the model.

In much previous singing synthesis work, the transitions from one phonetic segment to another have been represented by stylization of control parameter contours (e.g., formant tracks) through rules or interpolation schemes. Although many characteristics of the voice can be approximated with such techniques after painstaking hand-tuning of rules, very natural-sounding synthesis has remained an elusive goal.

In the speech synthesis field, many current systems back away from specification of such formant transition rules, and instead model phonetic transitions by concatenating segments from an inventory of collected speech data. For example, this is described by Macon, et al. in article in Proc. of International Conference on Acoustics, Speech and Signal Processing (Vol. 1, pp. 361–364, May 1996) entitled, "Speech Concatenation and Synthesis Using Overlap-Add Sinusoidal Model."

For Patents see, E. Bryan George, et al. U.S. Pat. No. 5,327,518 entitled, "Audio Analysis/Synthesis System" and E. Bryan George, et al. U.S. Pat. No. 5,504,833 entitled, "Speech Approximation Using Successive Sinusoidal Overlap-Add Models and Pitch-Scale Modifications." These patents are incorporated herein by reference.

SUMMARY OF THE INVENTION

In accordance with one embodiment of the present invention a singing voice synthesis is provided by providing a signal model and modifying said signal model using concatenated segments of singing voice units and musical control information to produce concatenated waveform segments.

These and other features of the invention will be apparent to those skilled in the art from the following detailed description of the invention, taken together with the accompanying drawings.

DESCRIPTION OF THE DRAWINGS

FIG. 2A and FIG. 2B is a catalog of variable-size units available to represent a given phoneme;

DESCRIPTION OF THE PREFERRED EMBODIMENT

Figure 1:
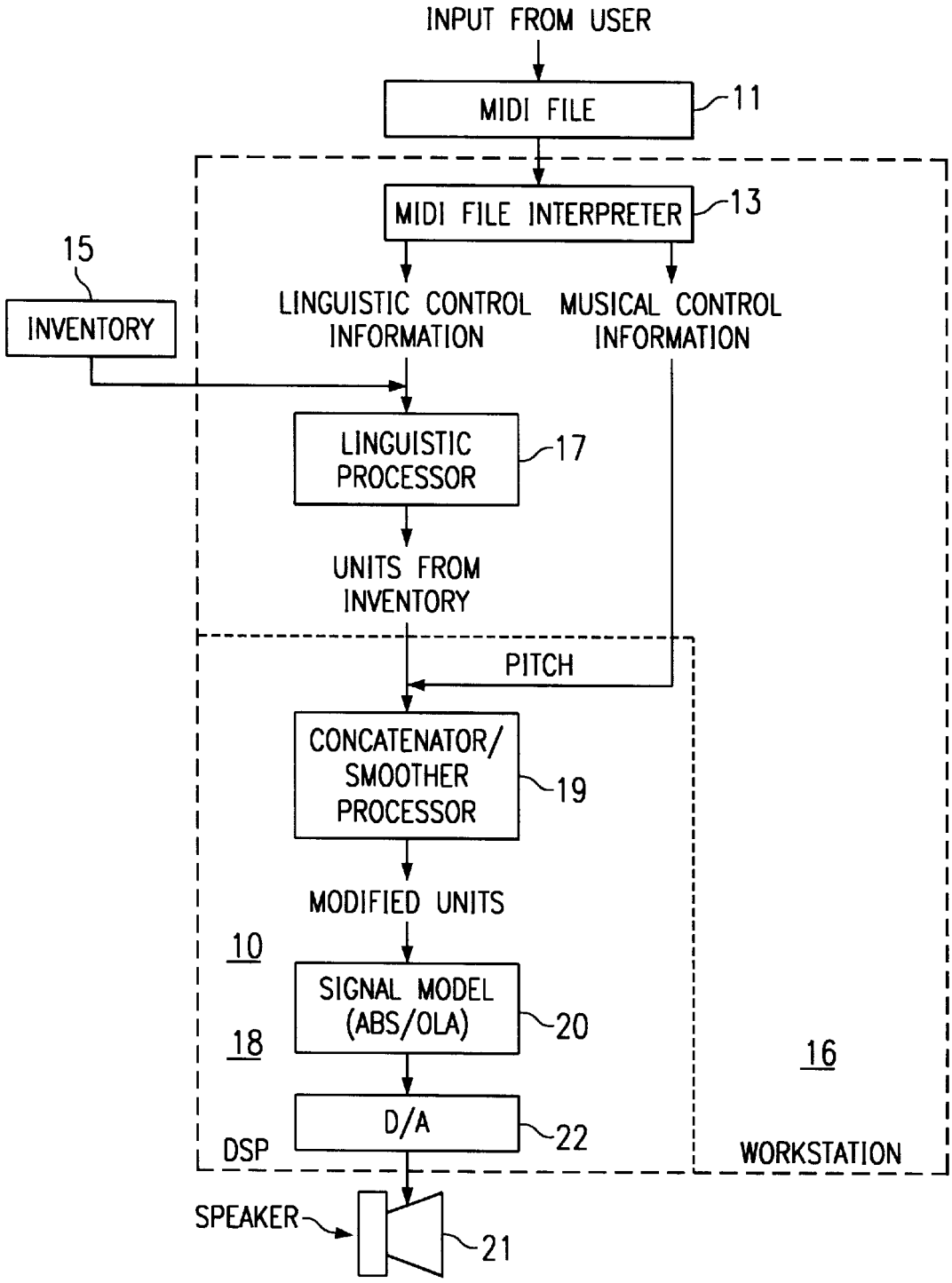
FIG. 1 is a block diagram of the system according to one embodiment of the present invention.

The system 10 shown in FIG. 1 uses, for example, a commercially-available MIDI-based (Musical Instrument Digital Interface) music composition software as a user interface 13. The user specifies a musical score and phonetically-spelled lyrics, as well as other musically interesting control parameters such as vibrato and vocal effort from MIDI file 11. This control information is stored in a standard MIDI file format that contains all information necessary to synthesize the vocal passage. The MIDI file interpreter 13 provides separately the linguistic control information for the words and the musical control information such as vibrato, vocal effect and vocal tract length, etc.

Based on this input MIDI file, linguistic processor 17 of the system 10 selects synthesis model parameters from an inventory 15 of voice data that has been analyzed off-line by the sinusoidal model. Units are selected at linguistic processor 17 to represent segmental phonetic characteristics of the utterance, including coarticulation effects caused by the context of each phoneme. These units are applied to concatenator/smoother processor 19. At processor 19, algorithms as described in Macon, et al. "Speech Concatenation and Synthesis using Overlap-Add Sinusoidal Model" in Proc. of International Conference on Acoustics, Speech and Signal Processing (Vol. 1, pp.361–364, May 1996) are applied to the modeled segments to remove disfluencies in the signal at the joined boundaries. The sinusoidal model parameters are then used to modify the pitch, duration, and spectral characteristics of the concatenated voice units as specified by the musical score and MIDI control information. Finally, the output waveform is synthesized at signal model 20 using the ABS/OLA sinusoidal model. This output of model 20 is applied via a digital to analog converter 22 to the speaker 21. The MIDI file interpreter 13 and processor 17 can be part of a workstation PC 16 and processor 19 and signal model 20 can be part of a workstation or a Digital Signal Processing (DSP) 18. Separate MIDI files 13 can be coupled into the workstation 16. The interpreter 13 converts to machine information. The inventory 15 is also coupled to the workstation 16 as shown. The output from the model 20 may also be provided to files for later use.

The signal model 20 used is an extension of the Analysis-by-Synthesis/Overlap-Add (ABS/OLA) sinusoidal model of E. Bryan George, et al. in Journal of the Audio Engineering Society (Vol. 40, pp.497–516, June 1992) entitled, "An Analysis-by-Synthesis Approach to Sinusoidal Modeling Applied to the Analysis and Synthesis of Musical Tones." In the ABS/OLA model, the input signal s[n] is represented by a sum of overlapping short-time signal frames sk[n].

$$s[n] = \sigma[n]\sum_k w[n - kN_s]s_k[n] \tag{1}$$

where $N_s$ is the frame length, w[n] is a window function, σ[n] is a slowly time-varying gain envelope, and $S_k[n]$ represents the kth frame contribution to the synthesized signal. Each signal contribution $S_k[n]$ consists of the sum of a small number of constant-frequency, constant-amplitude sinusoidal components. An interactive analysis-by-synthesis procedure is performed to find the optimal parameters to represent each signal frame. See U.S. Pat. No. 5,327,518 of E. Bryan George, et al. incorporated herein by reference.

Synthesis is performed by an overlap-add procedure that uses the inverse fast Fourier transform to compute each contribution $S_k[n]$, rather than sets of oscillator functions. Time-scale modification of the signal is achieved by changing the synthesis frame duration and pitch modification is performed by altering the sinusoidal components such that the fundamental frequency is modified while the speech formant structure is maintained.

The flexibility of this synthesis model enables the incorporation of vocal qualities such as vibrato and spectral tilt variation, adding greatly to the musical expressiveness of the synthesizer output.

While the signal model of the present invention is the preferred ABS/OLA sinusoidal model, other sinusoidal models as well as sampler models, wavetable models, formant synthesis model and physical models such as waveguide model may also be used. Some of these models with referenced are discussed in the background. For more details on the ABS/OLA model, see E. Bryan George, et al. U.S. Pat. No. 5,327,518.

The synthesis system presented in this application relies on an inventory of recorded singing voice data 15 to represent the phonetic content of the sung passage. Hence an important step is the design of a corpus of singing voice data that adequately covers allophonic variations of phonemes in various contexts. As the number of "phonetic contexts" represented in the inventory increases, better synthesis results will be obtained, since more accurate modeling of coarticulatory effects will occur. This implies that the inventory should be made as large as possible. This goal, however, must be balanced with constraints of (a) the time and expense involved in collecting the inventory, (b) stamina of the vocalist, and (c) storage and memory constraints of the synthesis computer hardware. Other assumptions are:

a.) For any given voiced speech segment, re-synthesis with small pitch modifications produces the most natural-sounding result. Thus, using an inventory containing vowels sung at several pitches will result in better-sounding synthesis, since units close to the desired pitch will usually be found.

b.) Accurate modeling of transitions to and from silence contributes significantly to naturalness of the synthesized segments.

c.) Consonant clusters are difficult to model using concatenation, due to coarticulation and rapidly varying signal characteristics.

To make best use of available resources, the assumption can be made that the musical quality of the voice is more critical than intelligibility of the lyrics. Thus, the fidelity of sustained vowels is more important than that of consonants. Also, it can be assumed that, based on features such as place and manner of articulation and voicing, consonants can be grouped into "classes" that have somewhat similar coarticulatory effects on neighboring vowels.

Thus, a set of nonsense syllable tokens was designed with a focus on providing adequate coverage of vowels in a minimal amount of recording. All vowels V were presented within the contexts $C_L V$ and $VC_R$, where $C_L$ and $C_R$ are classes of consonants (e.g. voiced stops, unvoiced fricatives, etc.) located to the left and right of a vowel as listed in Table 1 of Appendix A. The actual phonemes selected from each class were chosen sequentially such that each consonant in a class appeared a roughly equal number of times across all tokens. These $C_L V$ and $VC_R$ units were then paired arbitrarily to form $C_L VC_R$ units, then embedded in a "carrier" phonetic context to avoid word boundary effects.

This carrier context consisted of the neutral vowel /ax/ (in ARPAbet notation), resulting in units of the form /ax/ $C_L VC_R$/ax/. Two nonsense word tokens for each /ax/$C_L VC_R$/ ax/ unit were generated, and sung at high and low pitches within the vocalist's natural range.

Transitions of each phoneme to and from silence were generated as well.

For vowels, these units were sung at both high and low pitches. The affixes _/s/ and _/z/ were also generated in the context of all valid phonemes. The complete list of nonsense words is given in Tables 2 and 3 of Appendix A.

A set of 500 inventory tokens was sung by a classically-trained male vocalist to generate the inventory data. Half of these 500 units were sung at a pitch above the vocalist's normal pitch, and half at a lower pitch. This inventory was then phonetically annotated and trimmed of silences, mistakes, etc. using Entropic x-waves and a simple file cutting program resulting in about ten minutes of continuous singing data used as input to the off-line sinusoidal model analysis. (It should be noted that this is a rather small inventory size, in comparison to established practices in concatenative speech synthesis.)

Given this phonetically-annotated inventory of voice data, the task at hand during the online synthesis process is to select a set of units from this inventory to represent the input lyrics. This is done at processor 17. Although it is possible to formulate unit selection as a dynamic programming problem that finds an optimal path through a lattice of all possible units based on acoustic "costs," (e.g., Hunt, et al. "Unit Selection in a Concatenative Speech Synthesis System Using a large Speech Database," in Proc. of International Conference on Acoustics, Speech and Signal Processing, Vol. 1, pp. 373–376, 1996) the approach taken here is a simpler one designed with the constraints of the inventory in mind: best-context vowel units are selected first, and consonant units are selected in a second pass to complete the unit sequence.

The method used for choosing the each unit involves evaluating a "context decision tree" for each input phoneme. The terminal nodes of the tree specify variable-size concatenation units ranging from one to three phonemes in length. These units are each given a "context score" that orders them in terms of their agreement with the desired phonetic context, and the unit with the best context score is chosen as the unit to be concatenated. Since longer units generally result in improved speech quality at the output, the method places a priority on finding longer units that match the desired phonetic context. For example, if an exact match of a phoneme and its two neighbors is found, this triphone is used directly as a synthesis unit.

For a given ph oneme P in the input phone tic string and its left and right neighbors, $P_L$ and $P_R$, the selection algorithm attempts to find P in a context most closely matched to $P_L$ P $P_R$. When exact context matches are found, the algorithm extracts the matching adjacent phoneme(s) as well, to preserve the transition between these phonemes. Thus, each extracted unit consists of an instance of the target phoneme and one or both of its neighboring phonemes (i.e., it extracts a monophone, diphone, or triphone). FIG. 2 shows a catalog of all possible combinations of monophones, diphones, and triphones, including class ma tch properties, ordered by their preference for synthesis.

In addition to searching for phonemes in an exact phonemic context , however, the system also is capable of finding phonemes that have a context similar, but not identical, to the desired triphone context. For example, if a desired triphone cannot be found in the inventory, a diphone or monop hone taken from an acoustically similar context is used instead.

For example, if the algorithm is searching for lael in the context /d/-/ae/-/d/, but this triphone cannot be found in the inventory, the monophone /ae/ taken from the context /b/-/ae/-/b/ can be used instead, since /b/ and /d/ have a similar effect on the neighboring vowel. The notation of FIG. 2 indicates the resulting unit output, along with a description of the context rules satisfied by the units. In the notation of this figure, $x_L P_1 x_R$ indicates a phoneme with an exact triphone context match (as /d/-/ae/-/d/ would be for the case described above). The label $c_L P_1 c_R$ indicates a match of phoneme class on the left and right, as for /b/-/ae/-/b/ above. Labels with the symbol $P_2$ indicate a second unit is used to provide the final output phonemic unit. For example, if /b/-/ae/-/k/ and /k/-/ae/-/b/ can be found, the two lael monophones can be joined to produce an /ae/ with the proper class context match on either side.

Figure 3:
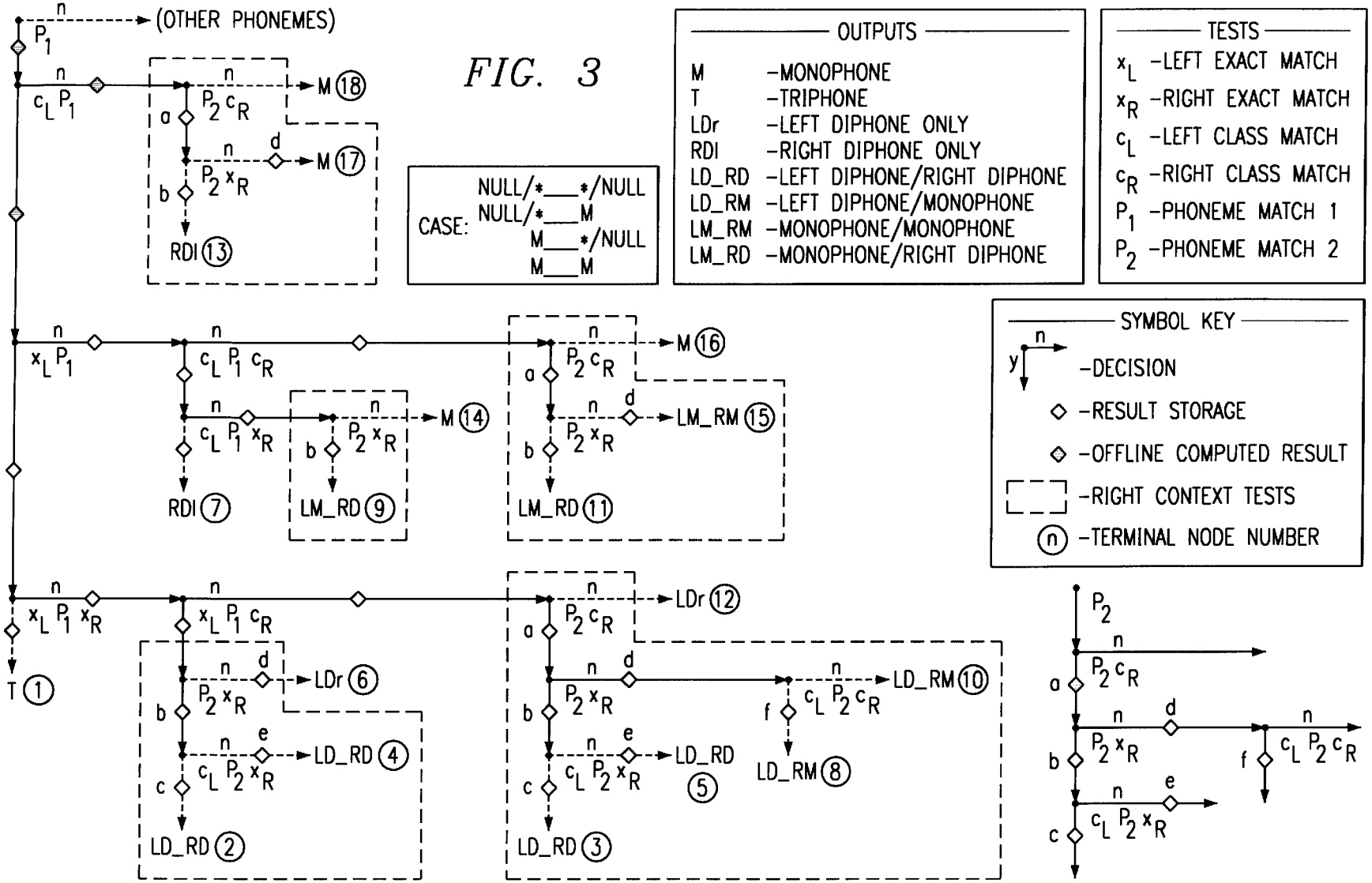
FIG. 3 illustrates a decision tree for context matching.

In order to find the unit with the most appropriate available context, a binary decision tree was used (shown in FIG. 3). Nodes in this tree indicate a test defined by the context label next to each node. The right branch out of each node indicates a "no" response; downward branches indicate "yes". Terminal node numbers correspond to the outputs defined in FIG. 2. Diamonds on the node branches indicate storage arrays that must be maintained during the processing of each phoneme. Regions enclosed in dashed lines refer to a second search for phonemes with a desired right context to supplement the first choice (the case described at the end of the previous paragraph). The smaller tree at the bottom right of the diagram describes all tests that must be conducted to find this second phoneme. The storage locations here are computed once and used directly in the dashed boxes. To save computation at runtime, the first few tests in the decision tree are performed off-line and stored in a file. The results of the precomputed branches are represented by filled diamonds on the branches.

After the decision tree is evaluated for every instance of the target phoneme, the (nonempty) output node representing the lowest score in FIG. 2 is selected. All units residing in this output node are then ranked according to their closeness to the desired pitch (as input in the MIDI file). A rough pitch estimate is included in the phonetic labeling process for this purpose. Thus the unit with the best phonetic context match and the closest pitch to the desired unit is selected.

Figure 4:
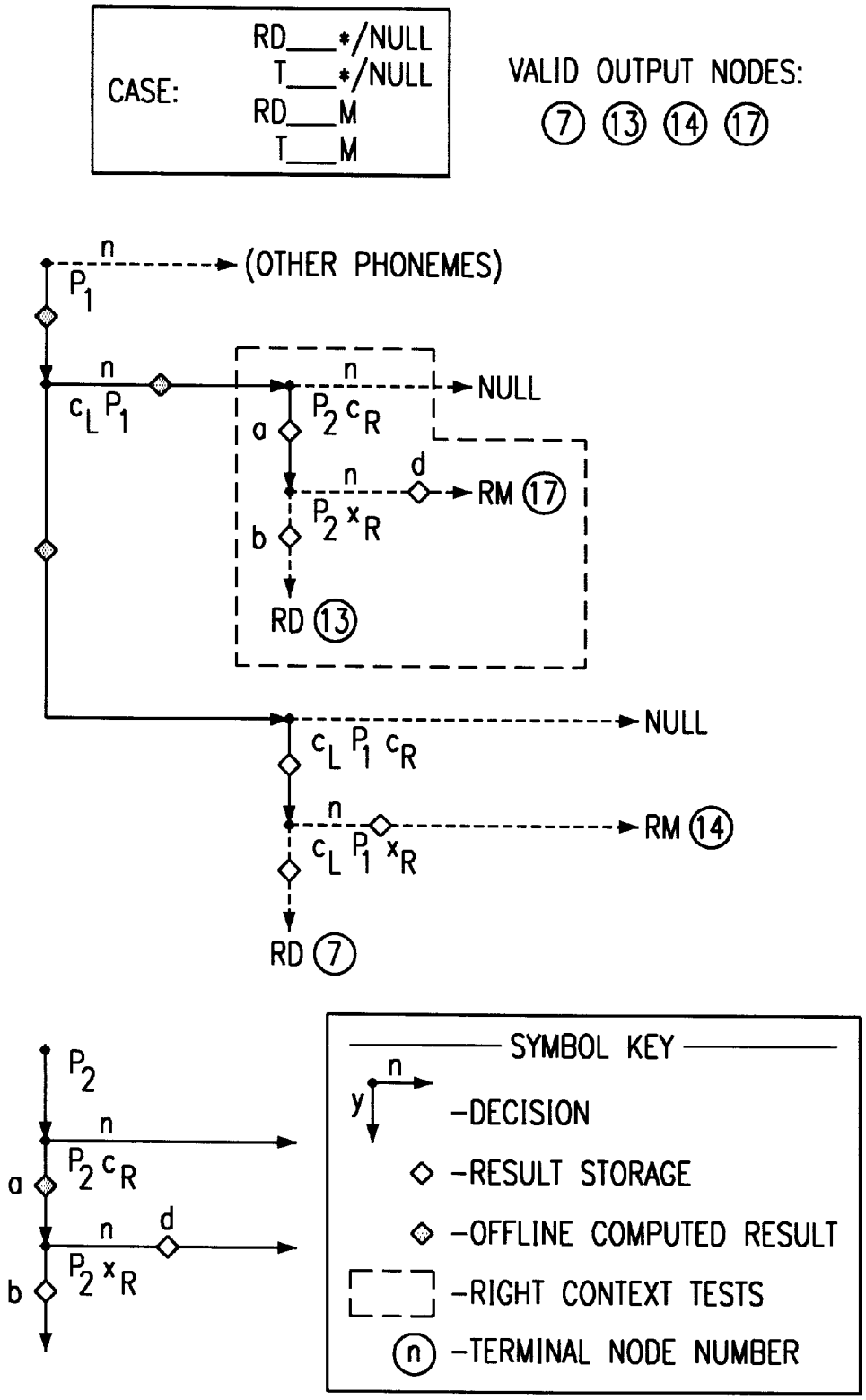
FIG. 4 illustrates decision tree for phonemes preceded by an already-chosen diphone or triphone.
Figures 5, 6:
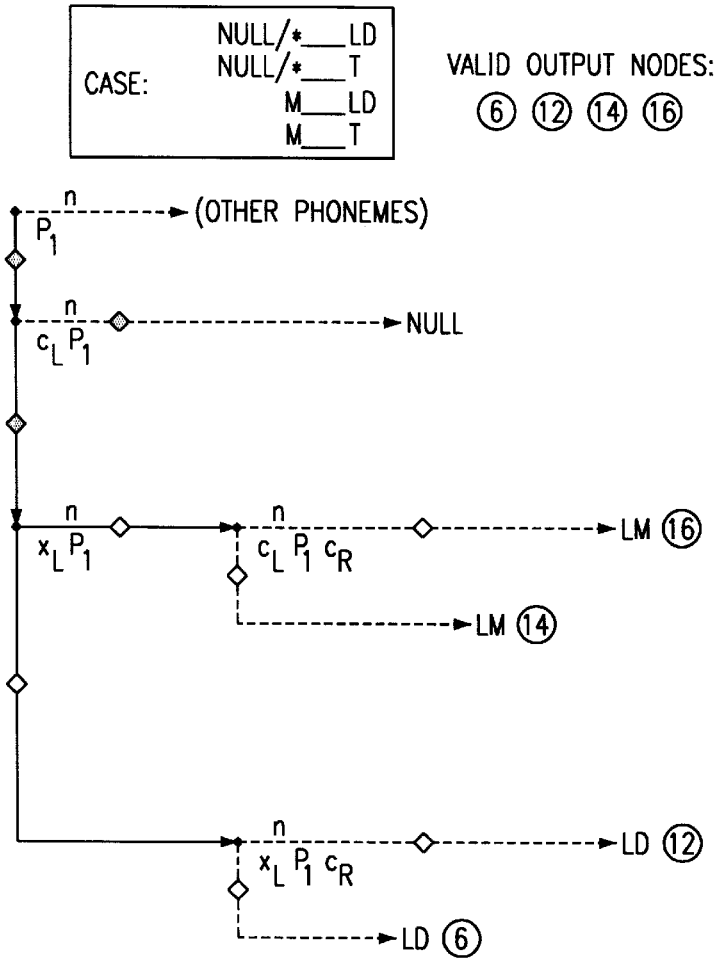
FIG. 5 illustrates decision tree phonemes followed by an already-chosen diphone or triphone.
FIG. 6 is a transition matrix for all unit-unit combinations.

The decision to develop this method instead of implementing the dynamic programming method is based on the following rationale: Because the inventory was constructed with emphasis on providing a good coverage of the necessary vowel contexts, "target costs" of phonemes in dynamic programming should be biased such that units representing vowels will be chosen more or less independently of each other. Thus a slightly suboptimal, but equally effective, method is to choose units for all vowels first, then go back to choose the remaining units, leaving the already-specified units unchanged. Given this, three scenarios must be addressed to "fill in the blanks":

1. Diphones or triphones have been specified on both sides of the phoneme of interest. Result: a complete specification of the desired phoneme has already been found, and no units are necessary.
2. A diphone or triphone has been specified on the left side of the phoneme of interest. Result: The pruned decision tree in FIG. 4 is used to specify the remaining portion of the phoneme.
3. A diphone or triphone has been specified on the right side of the phoneme of interest. Result: The pruned decision tree in FIG. 5 is used to specify the remaining portion of the phoneme.

If no units have been specified on either side, or if monophone only have been specified, then the general decision tree in FIG. 3 can be used.

This inexact matching is incorporated into the context decision tree by looking for units that match the context in terms of phoneme class (as defined above). The nominal pitch of each unit is used as a secondary selection criterion when more than one "best-context" unit is available.

Once the sequence of units has been specified using the decision tree method described above, concatenation and smoothing of the units takes place.

Each pair of units is joined by either a cutting/smoothing operation or an "abutting" of one unit to another. The type of unit-to-unit transition uniquely specifies whether units are joined (cut and smoothed) or abutted. FIG. 6 shows a "transition matrix" of possible unit-unit sequences and their proper join method. It should be noted that the NULL unit has zero length—it serves as a mechanism for altering the type of join in certain situations.

The rest of this section will describe in greater detail the normalization, smoothing and prosody modification stages.

Figure 7:
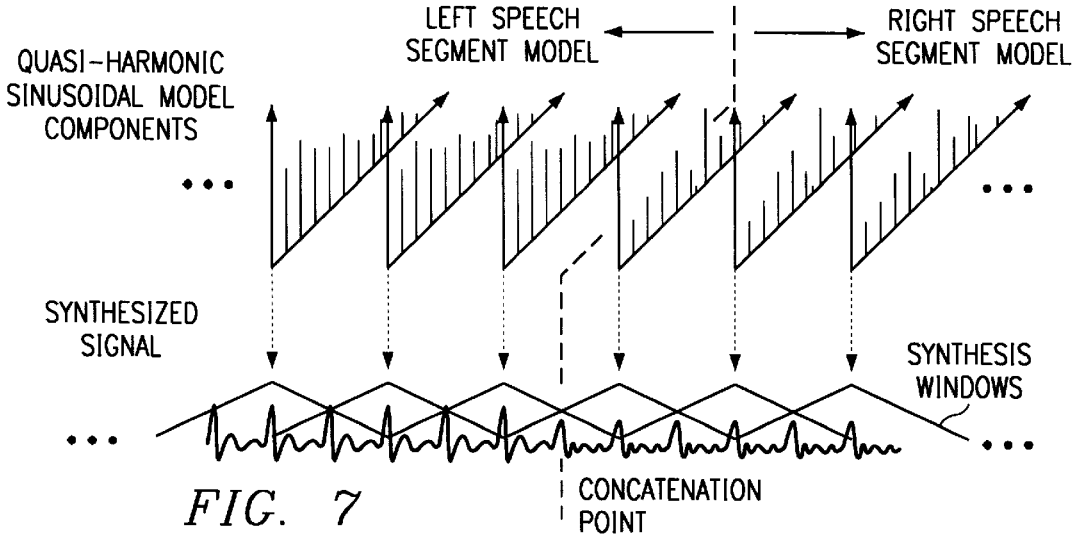
FIG. 7 illustrates concatenation of segments using sinusoidal model parameters.

The ABS/OLA sinusoidal model analysis generates several quantities that represent each input signal frame, including (i) a set of quasi-harmonic sinusoidal parameters for each frame (with an implied fundamental frequency estimate), (ii) a slowly time-varying gain envelope, and (iii) a spectral envelope for each frame. Disjoint modeled speech segments can be concatenated by simply stringing together these sets of model parameters and re-synthesizing, as shown in FIG. 7. However, since the jointed segments are analyzed from disjoint utterances, substantial variations between the time- or frequency-domain characteristics of the signals may occur at the boundaries. These differences manifest themselves in the sinusoidal model parameters. Thus, the goal of the algorithms descibed here is to make discontinuities at the concatenation points inaudible by altering the sinusoidal model components in the neighborhood of the boundaries.

The units extracted from the inventory may vary in short-time signal energy, depending on the characteristics of the utterances from which they were extracted. This variation gives the output speech a very stilted, unnatural rhythm. For this reason, it is necessary to normalize the energy of the units. However, it is not straightforward to adjust units that contain a mix of voiced and unvoiced speech and/or silence, since the RMS energy of such segments varies considerably depending on the character of the unit.

The approach taken here is to normalize only the voiced sections of the synthesized speech. In the analysis process, a global RMS energy for all voiced sounds in the inventory is found. Using this global target value, voiced sections of the unit are multiplied by a gain term that modifies the RMS value of each section to match the target. This can be performed by operating directly on the sinusoidal model parameters for the unit. The average energy (power) of a single synthesized frame of length $N_s$ can be written as $$E_{fr}^2 = \frac{1}{N_s}\sum_{n=0}^{N_s-1} |s[n]|^2 = \frac{1}{N_s}\sum_{n=0}^{N_s-1}\left|\sigma[n]\sum_k a_k\cos(\omega_k n+\phi_k)\right|^2. \quad (2)$$

Assuming that σ[n] is relatively constant over the duration of the frame, Equation (2) can be reduced to $$E_{fr}^2 = \frac{\overline{\sigma}^2}{1N_s}\sum_k a_k^2\sum_{n=0}^{N_s-1}|\cos(\omega_k n+\phi_k)|^2 \approx \frac{1}{2}\overline{\sigma}^2\sum_k a_k^2, \quad (3)$$

where $\overline{\sigma}^2$ is the square of the average of σ[n] over the fiame. This energy estimate can be found for the voiced sections of the unit, and a suitable gain adjustment can be easily found. In practice, the applied gain function is smoothed to avoid abrupt discontinuities in the synthesized signal energy.

Figure 8A:
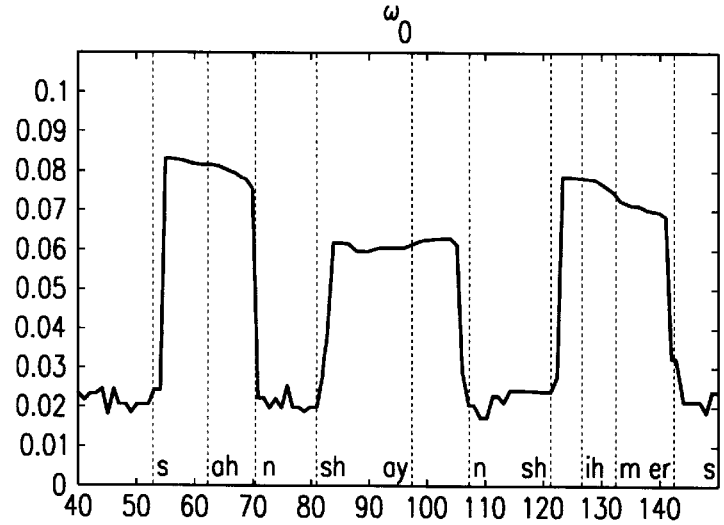
FIG. 8A is the fundamental frequency.
Figure 8B:
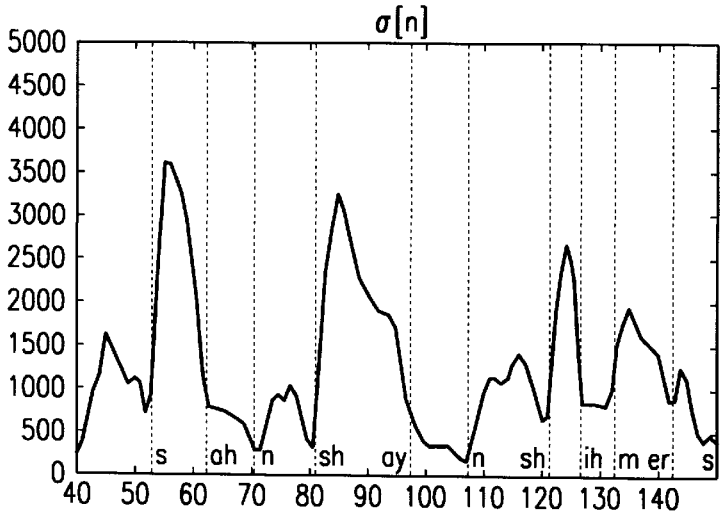
FIG. 8B is the gain envelope plots for the phrase " . . . sunshine shimmers . . .
Figure 8C:
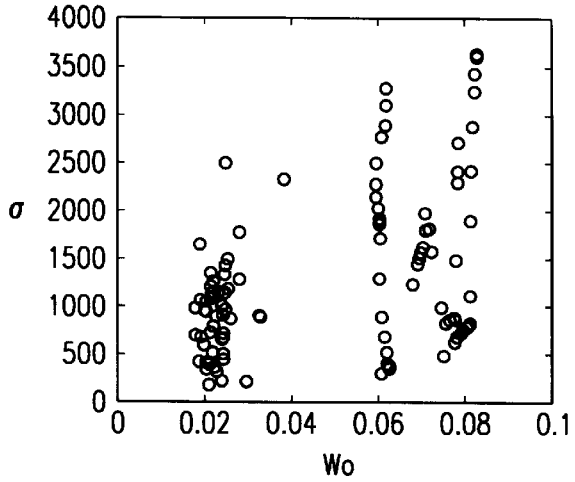
" and FIG. 8C is a plot of these two quantities against to each other.

In the energy normalization described above, only voiced segments are adjusted. This implies that a voiced/unvoiced decision must be incorporated into the analysis. Since several parameters of the sinusoidal model are already available as a byproduct of the analysis, it is reasonable to attempt to use these to make a voicing decision. For instance, the pitch detection algorithm of the ABS/OLA model (described in detail in cited article and patent of George, typically defaults to a low frequency estimate below the speaker's normal pitch range when applied to unvoiced speech. FIG. 8A shows fundamental frequency and FIG. 8B shows the gain contour plots for the phrase "sunshine shimmers," spoken by a female, with a plot of the two against each other in FIG. 8C to the right. It is clear from this plot (and even the $\omega_0$ plot alone) that the voiced and unvoiced sections of the signal are quite discernible based on these values due to the clustering of data.

For this analyzed phrase, it is easy to choose thresholds of pitch or energy to discriminate between voiced and unvoiced frames, but it is difficult to choose global thresholds that will work for different talkers, sampling rates, etc. By taking advantage of the fact that this analysis is performed off-line, it is possible to choose automatically such thresholds for each utterance, and at the same time make the V/UV decision more robust (to pitch errors, etc.) by including more data in the V/UV classification.

This can be achieved by viewing the problem as a "nearest-neighbor" clustering of the data from each frame, where feature vectors consisting of $\omega_0$ estimates, frame energy, and other data are defined. The centroids of the clusters can be found by employing the K-means (or LBG) algorithm commonly used in vector quantization, with K=2 (a voiced class and an unvoiced class). This algorithm consists of two steps:

1. Each of the feature vectors is clustered with one of the K centroids to which it is "closest," as defined by a distance measure, d(v, c).
2. The centroids are updated by choosing as the new centroid the vector that minimizes the average distortion between it and the other vectors in the cluster (e.g., the mean if a Euclidean distance is used).

These steps are repeated until the clusters/centroids no longer change. In this case the feature vector used in the voicing decision is $$v=[\omega_0\bar{\sigma}H_{SNR}]^T, \quad (4)$$

where $\omega_0$ is the fundamental frequency estimate for the frame, $\bar{\sigma}$ is the average of the time envelope $\sigma[n]$ over the frame, and $H_{NSR}$ is the ratio of the signal energy to the energy in the difference between the "quasiharmonic" sinusoidal components in the model and the same components with frequencies forced to be harmonically related. This is a measure of the degree to which the components are harmonically related to each other. Since these quantities are not expressed in terms of units that have the same order of magnitude, a weighted distance measure is used:

$$d(v, c)=(v-c)^T C^{-1}(v-c), \quad (5)$$

where C is a diagonal matrix containing the variance of each element of v on its main diagonal.

Figure 9:
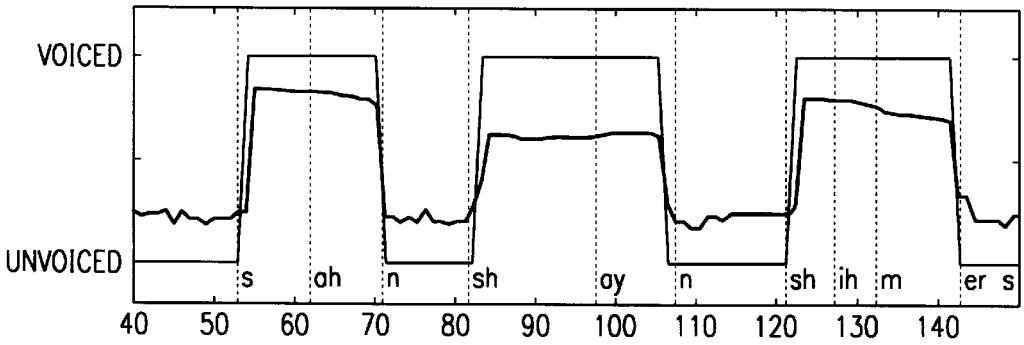
FIG. 9 illustrates the voicing decision result, $\omega_0$ contour and phonetic annotation for the phrase " . . . sunshine shimmers . . . " using nearest neighbor clustering method.

This general framework for discrimination voiced and unvoiced frames has two benefits: (i) it eliminates the problem of manually setting thresholds that may or may not be valid across different talkers; and (ii) it adds robustness to the system, since several parameters are used in the V/UV discrimination. For instance, the inclusion of energy values in addition to fundamental frequency makes the method more robust to pitch estimation errors. The output of the voicing decision algorithm for an example phrase is shown in FIG. 9.

The unit normalization method described above removes much of the energy variation between adjacent segments extracted from the inventory. However, since this normalization is performed on a fairly macroscopic level, perceptually significant short-time signal energy mismatches across concatenation boundaries remain.

An algorithm for smoothing the energy mismatch at the boundary of disjoint speech segments is described as follows:

1. The frame-by-frame energies of $N_{smooth}$ frames (typically on the order of 50 ms) around the concatenation point are found using Equation (3).
2. The average frame energies for the left and right segments, given by $E_L$ and $E_R$, respectively, are found.
3. A target value, $E_{target}$, for the energy at the concatenation point is determined. The average $E_L$ and $E_R$ in the previous step is a reasonable assumption for such a target value.
4. Gain corrections $G_L$ and $G_R$ are found by $$G_L = \sqrt{\frac{E_{target}}{E_L}} \qquad G_R = \sqrt{\frac{E_{target}}{E_R}}.$$

Figure 10:
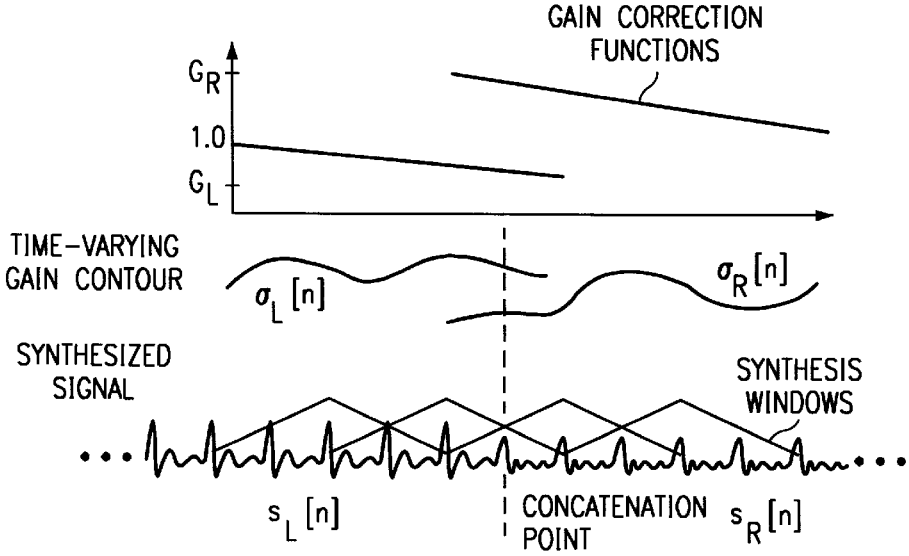
FIG. 10 illustrates short-time energy smoothing.

5. Linear gain correction functions that interpolate from a value of 1 and the ends of the smoothing region to $G_L$ and $G_R$ at the respective concatenation points are created, as shown in FIG. 10. These functions are then factored into the gain envelopes $\sigma_L[n]$ and $\sigma_R[n]$.

It should be noted that incorporating these gain smoothing functions into $\sigma_L[n]$ and $\sigma_R[n]$ requires a slight change in methodology. In the original model, the gain envelope $\sigma[n]$ is applied after the overlap-add of adjacent frames, i.e., $$x[n]=\sigma[n](w_s[n]s_L[n]+(1-w_s[n])s_R[n]),$$

where $w_s[n]$ is the window function, and $S_L[n]$ and $S_R[n]$ are the left and right synthetic contributions, respectively. However, both $\sigma_L[n]$ and $\sigma_R[n]$ should be included in the equation for the disjoint segments case. This can be achieved by splitting $\sigma[n]$ into 2 factors in the previous equation and then incorporating the left and right time-varying gain envelopes $\sigma_L[n]$ and $\sigma_R[n]$ as follows:

$$x[n]=w_s[n]\sigma_L[n]s_L[n]+(1-w_s[n])\sigma_R[n]s_R[n].$$

This algorithm is very effective for smoothing energy mismatches in vowels and sustained consonants. However, the smoothing effect is undesirable for concatenations that occur in the neighborhood of transient portions of the signal (e.g. plosive phonemes like /k/), since "burst" events are smoothed in time. This can be overcome by using phonetic label information available in the TTS system to vary $N_{smooth}$ based on the phonetic context of the unit concatenation point.

Another source of perceptible discontinuity in concatenated signal segments is mismatch in spectral shape across boundaries. The segments being joined are somewhat similar to each other in basic formant structure, due to matching of the phonetic context in unit selection. However, differences in spectral shape are often still present because of voice quality (e.g., spectral tilt) variation and other factors.

One input to the ABS/OLA pitch modification algorithm is a spectral envelope estimate represented as a set of low-order cepstral coefficients. This envelope is used to maintain formant locations and spectral shape while frequencies of sinusoids in the model are altered. An "excitation model" is computed by dividing the lth complex sinusoidal amplitude $a_l e^{j\phi_l}$ by the complex spectral envelope estimate $H(\omega)$evaluated at the sinusoid frequency $\omega_l$. These excitation sinusoids are then shifted in frequency by a factor $\beta$, and the spectral envelope is re-multiplied by $H(\beta\omega_l)$ to obtain the pitch-shifted signal. This operation also provides a mechanism for smoothing spectral differences over the concatenation boundary, since a different spectral envelope may be reintroduced after pitch-shifting the excitation sinusoids.

Figure 11:
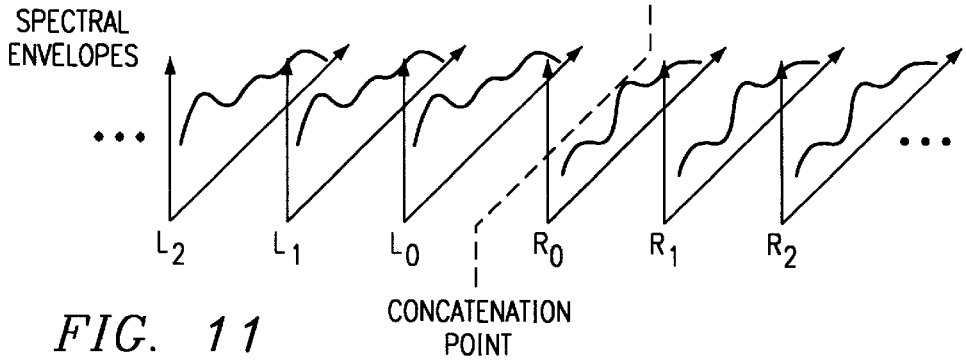
FIG. 11 illustrates Cepstral envelope smoothing.

Spectral differences across concatenation points are smoothed by adding weighted versions of the cepstral feature vector from one segment boundary to cepstral feature vectors from the other segment, and vice-versa, to compute a new set of cepstral feature vectors. Assuming that cepstral features for the left-side segment $\{\ldots, L2, L_1, L_0\}$ and features for the right-side segment $\{R_0, R_1, R_2 \ldots\}$ are to be concatenated as shown in FIG. 11, smoothed cepstral features $L_k^s$ for the left segment and $R_k^s$ for the right segment are found by:

$$L_k^s=w_kL_k+(1-w_k)R_0 \quad (7)$$

$$R_k^s=w_kR_k+(1-w_k)L_0 \quad (8)$$

where $$w_k = 0.5 + \frac{k}{2N_{smooth}},$$

$k=1,2,\ldots,N_{smooth}$ and where $N_{smooth}$ frames to the left and right of the boundary are incorporated into the smoothing. It can be shown that this linear interpolation of cepstral features is equivalent to linear interpolation of log spectral magnitudes.

Once $L_k^s$ and $R_k^s$ are generated, they are input to the synthesis routine as an auxiliary set of cepstral feature vectors. Sets of spectral envelopes $H_k(\omega)$ and $H_k^s(\omega)$ are generated from $\{L_k, R_k\}$ and $\{L_k^s, R_k^s\}$, respectively. After the sinusoidal excitation components have been pitch-modified, the sinusoidal components are multiplied by $H_k^s(\omega)$ for each frame k to impart the spectral shape derived from the smoothed cepstral features.

One of the most important functions of the sinusoidal model in this synthesis method is a means of performing prosody modification on the speech units.

It is assumed that higher levels of the system have provided the following inputs: a sequence of concatenationed, sinusoidal-modeled speech units; a desired pitch contour; and desired segmental durations (e.g., phone durations).

Given these inputs, a sequence of pitch modification factors $\{\beta_k\}$ for each frame can be found by simply computing the ratio of the desired fundamental frequency to the fundamental frequency of the concatenated unit. Similarly, time scale modification factors $\{\rho_k\}$ can be found by using the ratio of the desired duration of each phone (based on phonetic annotations in the inventory) to the unit duration.

The set of pitch modification factors generated in this manner will generally have discontinuities at the concatenated unit boundaries. However, when these-pitch modification factors are applied to the sinusoidal model frames, the resulting pitch contour will be continuous across the boundaries.

Proper alignment of adjacent frames is essential to producing high quality synthesized speech or singing. If the pitch pulses of adjacent frames do not add coherently in the overlap-add process a "garbled" character is clearly perceivable in the re-synthesized speech or singing. There are two tasks involved in properly aligning the pitch pulses: (i) finding points of reference in the adjacent synthesized frames, and (ii) shifting frames to properly align pitch pulses, based on these points of reference.

The first of these requirements is fulfilled by the pitch pulse onset time estimation algorithm described in E. Bryan George, et al. U.S. Pat. No. 5,327,518. This algorithm attempts to find the time at which a pitch pulse occurs in the analyzed frame. The second requirement, aligning the pitch pulse onset times, must be viewed differently depending on whether the frames to be aligned come from continuous speech or concatenated disjoint utterances. The time shift equation for continuous speech will be now be briefly reviewed in order to set up the problem for the concatenated voice case.

Figure 12:
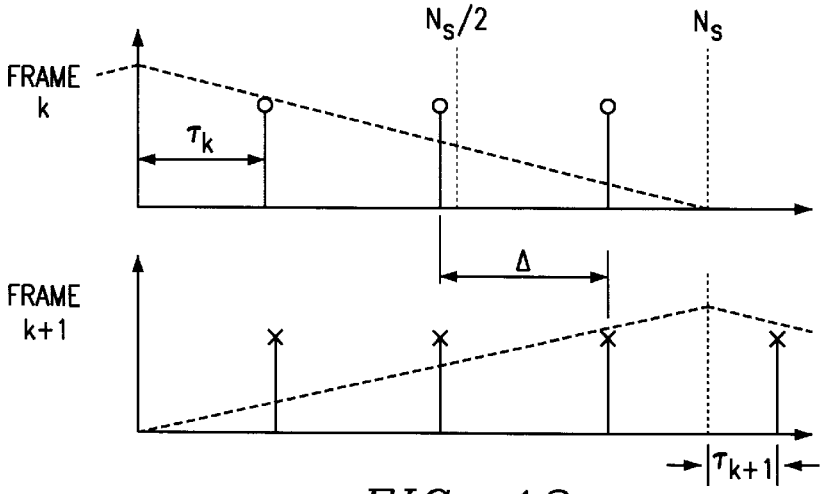
FIG. 12 illustrates pitch pulse alignment in absence of modification.
Figure 13:
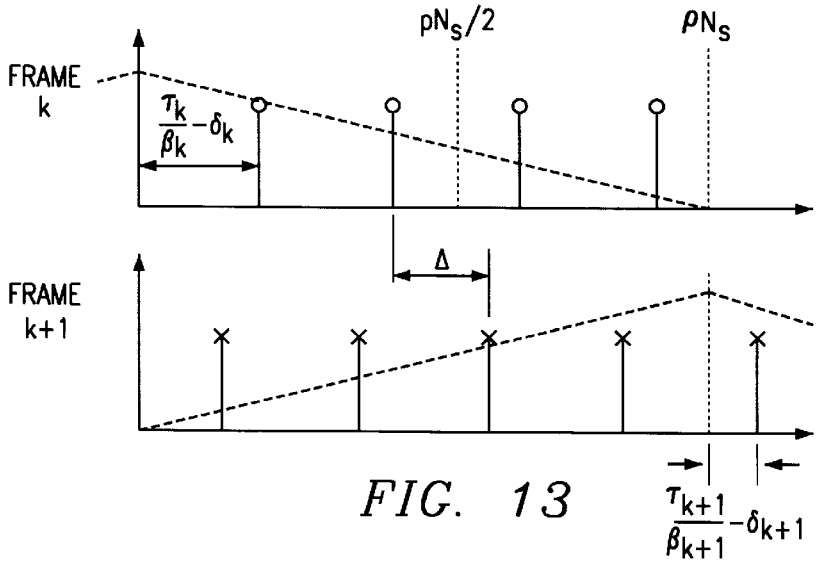
FIG. 13 illustrates pitch pulse alignment after modification.

The diagrams in FIGS. 12 and 13 depict the locations of pitch pulses involved in the overlap-add synthesis of one frame. Analysis frames k and k +1 each contribute to the synthesized frame, which runs from 0 to $N_s-1$. The pitch pulse onset times $\tau_k$ and $\tau_k+1$ describe the locations of the pitch pulse closest to the center of analysis frames k and k+1, respectively. In FIG. 13, the time-scale modification factor $\rho$ is incorporated by changing the length of the synthesis frame to $\rho N_s$, while pitch modification factors $\beta_k$ and $\beta_{k+1}$ are applied to change the pitch of each of the analysis frame contributions. A time shift $\delta$ is also applied to each analysis frame. We assume that time shift $\delta_k$ has already been applied, and the goal is to find $\delta_{k+1}$ to shift the pitch pulses such that they coherently sum in the overlap-add process.

From the schematic representation in FIG. 12, an equation for the time location of the pitch pulses in the original, unmodified frames k and k+1 can be written as follows:

$$t_k[i]=\tau_k+iT_0^k t_{k+1}[i]=\tau_{k+1}+iT_0^{k+1}, \tag{9}$$

while the indices I that refer to the pitch pulses closet to the center of the frame are given by:

$$\hat{l}_k = \left\lfloor \frac{\tau_k + \frac{N_s}{2}}{T_0^k} \right\rfloor \tag{10}$$

$$\hat{l}_{k+1} = -\left\lfloor \frac{\tau_{k+1} + \frac{N_s}{2}}{T_0^{k+1}} \right\rfloor$$

Thus $t_k[\hat{l}_k]$ and $t_{k+1}[\hat{l}_{k+1}]$ are the time locations of the pitch pulses adjacent to the center of the synthesis frame.

Referring to FIG. 13, equations for these same quantities can be found for the case where the time-scale/pitch modifications are applied:

$$t_k[i] = \frac{\tau_k}{\beta_k} - \delta_k + i\left(\frac{T_0^k}{\beta_0}\right) \tag{11}$$

$$t_{k+1}[i] = \frac{\tau_{k+1}}{\beta_{k+1}} - \delta_{k+1} + i\left(\frac{T_0^{k+1}}{\beta_{k+1}}\right) \tag{12}$$

$$\hat{l}_k = \left\lfloor \frac{-\tau_k + \beta_k\left(\delta_k + \frac{\rho N_s}{2}\right)}{T_0^k} \right\rfloor \tag{13}$$

$$\hat{l}_{k+1} = -\lambda\left\lfloor \frac{\tau_{k+1} + \rho\beta_{k+1}\frac{N_s}{2}}{T_0^{k+1}} \right\rfloor \tag{14}$$

Since the analysis frames k and k+1 were analyzed from continuous speech, we can assume that the pitch pulses will naturally line up coherently when $\beta=\rho=1$. Thus the time difference $\Delta$ in FIG. 13 will be approximately the average of the pitch periods $T_0^k$ and $T_0^{k+1}$. To find $\delta_{k+1}$ after modification, then, it is reasonable to assume that this time shift should become $\hat{\Delta}=\Delta/\beta_{av}$, where $\beta_{av}$ is the average of $\beta_k$ and $\beta_{k+1}$.

Letting $\hat{\Delta}=\Delta/\beta_{av}$ and using Equations (11) through (14) to solve for $\delta_{k+1}$ results in the time shift equation.

$$\delta_{k+1} = \delta_k + (\rho_k - 1/\beta_{av})N_s + \frac{\beta_k - \beta_{k+1}}{2\beta_{av}}\left(\frac{\tau_k}{\beta_k} + \frac{\tau_{k+1}}{\beta_{k+1}}\right) - \frac{\hat{l}_k}{\beta_k}T_0^k + (i_k T_0^k - i_{k+1}T_0^{k+1})/\beta_{av}. \tag{15}$$

It can easily be verified that Equation (15) results in $\delta_{k+1}=\delta_k$ for the case $\rho=\beta_k=\beta_{k+1}=1$. In other words, the frames will naturally line up correctly in the no-modification case since they are overlapped and added in a manner equivalent oto that of the analysis method. This behavior is advantageous, since it implies that even if the pitch pulse onset time estimate is in error, the speech will not be significantly affected when the modification factors $\rho$, $\beta_k$, and $\beta_{k+1}$ are close to 1.

The approach to finding $\delta_{k+1}$ given above is not valid, however, when finding the time shift necessary for the frame occurring just after a concatenation point, since even the condition $\rho=\beta_k=\beta_{k+1}=1$ (no modifications) does not assure that the adjacent frames will naturally overlap correctly. This is, again, due to the fact that the locations of pitch pulses (hence, onset times) of the adjacent frames across the boundary are essentially unrelated. In this case, a new derivation is necessary.

The goal of the frame alignment process is to shift frame k+1 such that the pitch pulses of the two frames line up and the waveforms add coherently. A reasonable way to achieve this is to force the time difference $\Delta$ between the pitch pulses adjacent to the frame center to be the average of the modified pitch periods in the two frames. It should be noted that this approach, unlike that above, makes no assumptions about the coherence of the pulses prior to modification. Typically, the modified pitch periods $T_0^k/\beta_k$ and $T_0^{k+1}/\beta_{k+1}$ will be approximately equal, thus, $$\Delta=\tilde{T}_0^{avg}=t_{k+1}[\hat{l}_{k+1}]+\rho N_s-t_k[\hat{l}_k], \tag{16}$$

where $$\tilde{T}_0^{avg}=\left(\frac{T_0^k}{\beta_k}+\frac{T_0^{k+1}}{\beta_{k+1}}\right)\Big/2.$$

Substituting Equations (11) through (14) into Equation (16) and solving for $\delta_{k+1}$, we obtain $$\delta_{k+1}=\delta_k+\frac{\tau_{k+1}}{\beta_{k+1}}-\frac{\tau_k}{\beta_k}+\hat{l}_{k+1}\left(\frac{T_0^{k+1}}{\beta_{k+1}}\right)-\hat{l}_k\left(\frac{T_0^k}{\beta_k}\right)+\rho N_s-\tilde{T}_0^{avg}. \tag{17}$$

This gives an expression for the time shift of the sinusoidal components in frame k+1. This time shift (which need not be an integer) can be implemented directly in the frequency domain by modifying the sinusoid phases $\phi_i$ prior to re-synthesis:

$$\phi_i=\phi_i+i\beta\omega_0\delta. \tag{18}$$

It has been confirmed experimentally that applying Equation (17) does indeed result in coherent overlap of pitch pulses at the concatenation boundaries in speech synthesis. However, it should be noted that this method is critically dependent on the pitch pulse onset time estimates $\tau_k$ and $\tau_{k+1}$. If either of these estimates is in error, the pitch pulses will not overlap correctly, distorting the output waveform. This underscores the importance of the onset estimation algorithm described in E. Bryan George, et al. U.S. Pat. No. 5,327,518. For modification of continuous speech, the onset time accuracy is less important, since poor frame overlap only occurs due to an onset time error when $\beta$ is not close to 1.0, and only when the difference between two onset time estimates is not an integer multiple of a pitch pulse. However, in the concatenation case, onset errors nearly always result in audible distortion, since Equation (17) is completely reliant on the correct estimation of pitch pulse-onset times to either side of the concatenation point.

Pitchrmarks derived from an electroglottograph can be used as initial estimates of the pitch onset time. Instead of relying on the onset time estimator to search over the entire range $[-T_0/2, T_0/2]$, the pitchmark closest to each frame center can be used to derive a rough estimate of the onset time, which can then be refined using the estimator function described earlier. The electroglottograph produces a measurement of glottal activity that can be used to find instants of glottal closure. This rough estimate dramatically improves the performance of the onset estimator and the output voice quality.

The musical control information such as vibrato, pitch, vocal effect scaling, and vocal tract scaling is provided from the MIDI file 11 via the MIDI file interpreter 13 to the concatenator/smoother 19 in FIG. 1 to perform modification to the units from the inventory.

Since the prosody modification step in the sinusoidal synthesis algorithm transforms the pitch of every frame to match a target, the result is a signal that does not exhibit the natural pitch fluctuations of the human voice.

In an article by Klatt, et al., entitled, "Analysis, Synthesis, and Perception of Voice Quality Variations Among Female and Male Talkers," Journal of the Acoustical Society of America (Vol. 87, pp. 820–857, February 1990), a simple equation for "quasirandom" pitch fluctuations in speech is proposed:

$$\Delta F_0=\frac{F_0}{100}(\sin(12.7\pi t)+\sin(7.1\pi t)+\sin(4.7\pi t))/3. \tag{19}$$

The addition of this fluctuation to the desired pitch contour gives the voice a more "human" feel, since a slight wavering is present in the voice. A global scaling of $\Delta F_0$ is incorporated as a controllable parameter to the user, so that more or less fluctuation can be synthesized.

Abrupt transitions of one note to another at a different pitch are not a natural phenomena. Rather, singers tend to transition somewhat gradually from one note to another. This effect can be modeled by applying a smoothing at note-to-note transitions in the target pitch contour. Timing of the pitch change by human vocalists is usually such that the transition between two notes takes place before the onset of the second note, rather than dividing evenly between the two notes.

The natural "quantal unit" of rhythm in vocal music is the syllable. Each syllable of lyric is associated with one or more notes of the melody. However, it is easily demonstrated that vocalists do not execute the onsets of notes at the beginnings of the leading consonant in a syllable, but rather at the beginning of the vowel. This effect has been cited in the study of rhythmic characteristics of singing and speech. Applicants' system 10 employs rules that align the beginning of the first note in a syllable with the onset of the vowel in that syllable.

In this work, a simple model for scaling durations of syllables is used. First an average time scaling factor $\rho_{syll}$ is computed:

$$\rho_{syll}=\frac{\sum_{n=1}^{N_{notes}} D_n}{\sum_{m=1}^{N_{phon}} D_m}, \tag{20}$$

where the values $D_n$ are the desired durations of the $N_{notes}$ notes associated with the syllable and $D_m$ are the durations of the $N_{phon}$ phonemes extracted from the inventory to compose the desired syllable. If $\rho_{syll}>1$, then the vowel in the syllable is looped by repeating a set of frames extracted from the stationary portion of the vowel, until $\rho_{syll}\approx 1$. This preserves the duration of the consonants, and avoids unnatural time-stretching effects. If $\rho syll<1$, the entire syllable is compressed in time by setting the time-scale modification factor $\rho$ for all frames in the syllable equal to $\rho_{syll}$.

A more sophisticated approach to the problem involves phoneme-and context-dependent rules for scaling phoneme durations in each syllable to more accurately represent the manner in which humans perform this adjustment.

The physiological mechanism of the pitch, amplitude, and timbral variation referred to as vibrato is somewhat in debate. However, frequency modulation of the glottal source waveform is capable of producing many of the observed effects of vibrato. As the source harmonics are swept across the vocal tract resonances, timbre and amplitude modulations as well as frequency modulation take place. These modulations can be implemented quite effectively via the sinusoidal model synthesis by modulating the fundamental frequency of the components after removing the spectral envelope shape due to the vocal tract (an inherent part of the pitch modification process).

Most trained vocalists produce a 5–6 Hz near-sinusoidal vibrato. As mentioned, pure frequency modulation of the glottal source can represent many of the observed effects of vibrato, since amplitude modulation will automatically occur as the partials "sweep by" the formant resonances. This effect is also easily implemented within the sinusoidal model framework by adding a sinusoidal modulation to the target pitch of each note. Vocalists usually are not able to vary the rate of vibrato, but rather modify the modulation depth to create expressive changes in the voice.

Using the graphical MIDI-based input to the system, users can draw contours that control vibrato depth over the course of the musical phrase, thus providing a mechanism for adding expressiveness to the vocal passage. A global setting of the vibrato rate is also possible.

In synthesis of bass voices using a voice inventory recorded from a baritone male vocalist, it was found that the voice took on an artificial-sounding "buzzy" quality, caused by extreme lowering of the fundamental frequency. Through analysis of a simple tube model of the human vocal tract, it can be shown that the nominal formant frequencies associated with a longer vocal tract are lower than those associated with a shorter vocal tract. Because of this, larger people usually have voices with a "deeper" quality; bass vocalists are typically males with vocal tracts possessing this characteristic.

To approximate the differences in vocal tract configuration between the recorded and "desired" vocalists, a frequency-scale warping of the spectral envelope (fit to the set of sinusoidal amplitudes in each frame) was performed, such that $$H(\omega)=H(\omega/\mu),$$

where $H(\omega)$ is the spectral envelope and $\mu$ is a global frequency scaling factor dependent on the average pitch modification factor. The factor $\mu$ typically lies in the range $0.75<\mu<1.0$. This frequency warping has the added benefit of slightly narrowing the bandwidths of the formant resonances, mitigating the buzzy character of pitch-lowered sounds. Values of $\mu>1.0$ can be used to simulate a more child-like voice, as well. In tests of this method, it was found that this frequency warping gives the synthesized bass voice a much more rich-sounding, realistic character.

Another important attribute of the vocal source in singing is the variation of spectral tilt with loudness. Crescendo of the voice is accompanied by a leveling of the usual downward tilt of the source spectrum. Since the sinusoidal model is a frequency-domain representation, spectral tilt changes can be quite easily implemented by adjusting the slope of the sinusoidal amplitudes. Breathiness, which manifests itself as high-frequency noise in the speech spectrum, is another acoustic correlate of vocal intensity. This frequency-dependent noise energy can be generated within the ABS/OLA model framework by employing a phase modulation technique during synthesis.

Figure 14:
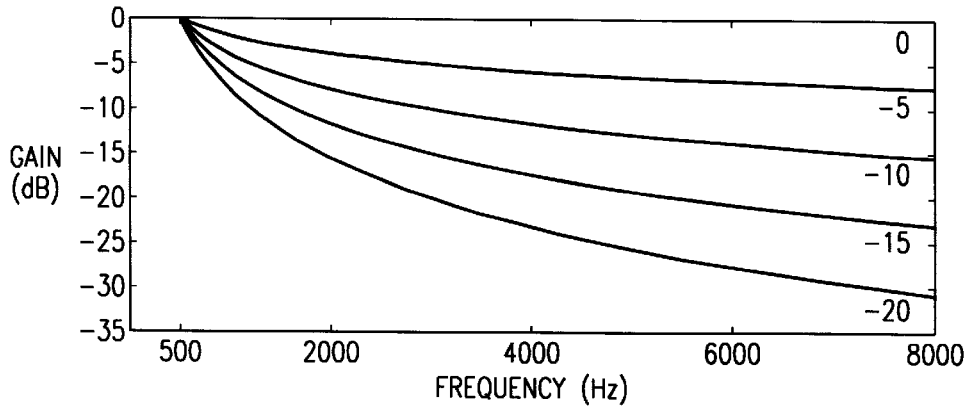
FIG. 14 illustrates spectral tilt modification as a function of frequency and parameter $T_{in}$.

Simply scaling the overall amplitude of the signal to produce changes in loudness has the same perceptual effect as turning the "volume knob" of an amplifier; it is quite different from a change in vocal effort by the vocalist. Nearly all studies of singing mention the fact that the downward tilt of the vocal spectrum increases as the voice becomes softer. This effect is conveniently implemented in a frequency-domain representation such as the sinusoidal model, since scaling of the sinusoid amplitudes can be performed. In the present system, an amplitude scaling function based on the work of Bennett, et al. in Current Directions in Computer Research (pp. 19–44) MIT Press, entitled, "Synthesis of the Singing Voice" is used:

$$G_{dB} = \frac{T_{in}\log_{10}(F_l/500)}{\log_{10}(3000/500)}, \tag{21}$$

where $F_l$ is the frequency of the lth sinusoidal component and $T_{in}$ is a spectral tilt parameter controlled by a MIDI "vocal effort" control function input by the user. This function produces a frequency-dependent gain scaling function parameterized by $T_{in}$ as shown in FIG. 14

Figure 15:
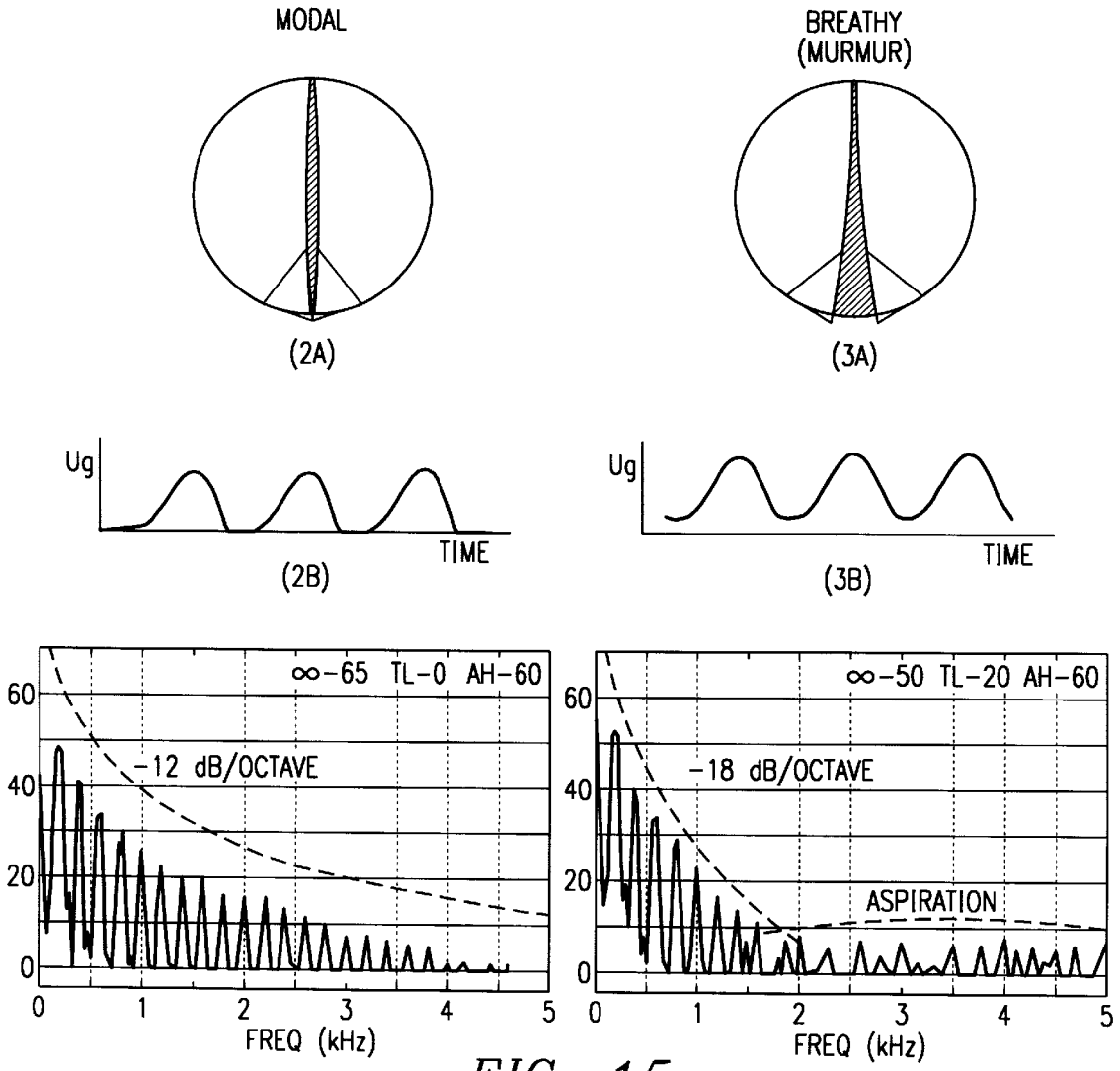
FIG. 15 illustrates spectral characteristics of the glottal source in model (normal) and breathy speech wherein top is a vocal fold configuration, middle is time domain waveform and bottom is short-time spectrum.

In studies of acoustic correlates of perceived voice qualities, it has been shown that utterances perceived as "soft" and "breathy" also exhibit a higher level of high frequency aspiration noise than fully phonated utterances, especially in females. This effect on glottal pulse shape and spectrum is shown in FIG. 15. It is possible to introduce a frequency-dependent noise-like character to the signal by employing the subframe phase randomization method. In this system, this capability has been used to model aspiration noise. The degree to which the spectrum is made noise-like is controlled by a mapping from the MIDI-controlled vocal effort parameter to the amount of phase dithering introduced.

Informal experiments with mapping the amount of randomization to (i) a cut-off frequency above which phases are dithered, and (ii) the scaling of the amount of dithering within a fixed band, have been performed. Employing either of these strategies results in a more natural, breathy, soft voice, although careful adjustment of the model parameters is necessary to avoid an unnaturally noisy quality in the output. A refined model that more closely represents the acoustics of loudness scaling and breathiness in singing is a topic for more extensive study in the future.

Although the present invention and its advantages have been described in detail, it should be understood that various changes, substitutions and alterations can be made herein without departing from the spirit and scope of the invention as defined by the appended claims.

What is claimed is:

1. A method of singing voice synthesis comprising the steps of:

providing a musical score and lyrics and musical control parameters;

providing an inventory of recorded linguistic singing voice data units that have been analyzed off-line by a sinusoidal model representing segmented phonetic characteristics of an utterance;

selecting said recorded linguistic singing voice data units dependent on lyrics;

joining said recorded linguistic singing voice data units and smoothing boundaries of said joined data units selected;

modifying the recorded linguistic singing voice data units that have been joined and smoothed according to musical score and other musical control parameters to provide directives for a signal model; and performing signal model synthesis using said directives.

2. The method of claim 1 wherein said signal model is a sinusoidal model.

3. The method of claim 2 wherein said sinusoidal model is an analysis-by-synthesis/overlap-add sinusoidal model.

4. The method of claim 1 wherein said selection of data units is by a decision tree method.

5. The method of claim 1 wherein said modifying step includes modifying the pitch, duration and spectral characteristics of the concatenated recorded linguistic singing voice data units as specified by the musical score and MIDI control information.

* * * * *